United States Patent [19]

Abarotin et al.

[11] 4,019,446

[45] Apr. 26, 1977

[54] RAIL GIRDER FOR SOAKING-PIT COVER

[75] Inventors: Eugene V. Abarotin, Murrysville; Michael A. Buckiso, Pittsburgh; Daniel T. Farley, North Huntingdon; Stephen R. Simko, Pittsburgh, all of Pa.

[73] Assignee: United States Steel Corporation, Pittsburgh, Pa.

[22] Filed: Nov. 26, 1975

[21] Appl. No.: 635,500

[52] U.S. Cl. ..... 110/173 A; 212/4

[51] Int. Cl.[2] ..... F23M 7/00

[58] Field of Search ..... 212/4; 110/173 R, 173 A, 110/173 B; 432/237, 250

[56] References Cited

UNITED STATES PATENTS

| | | | |
|---|---|---|---|
| 1,807,112 | 5/1931 | Werner | 110/173 X |
| 2,394,298 | 2/1946 | Fox et al. | 110/173 |
| 2,920,769 | 1/1960 | Spencer | 212/4 |
| 3,855,952 | 12/1974 | Sanderson | 110/173 |

*Primary Examiner*—Kenneth W. Sprague
*Attorney, Agent, or Firm*—John F. Carney

[57] ABSTRACT

A beam structure is described for supporting rails that carry wheeled cover carriages employed to close the openings of chambers in an industrial furnace of the soaking pit type. Each beam is disposed on the median wall between adjacent chambers and is arranged to mount a pair of rails, each of which is associated with one of the two adjacent chamber openings. The beam is structured and arranged to rapidly dissipate heat acquired during periods of furnace operation and especially due to exposure to the interior of the furnace when the associated cover is removed to thereby protect against undue thermal stressing. Ancillary insulating means may be appended to the structure in the most severely affected regions thereof.

8 Claims, 6 Drawing Figures

38
40
42
43
44
46
47
48
49
50
51
52
53
54
56
58
60
62
30
20
12
14
IV
V

RAIL GIRDER FOR SOAKING-PIT COVER

BACKGROUND OF THE INVENTION

The present invention relates generally to removable covers for top loading industrial furnaces, such as soaking pits and, more particularly, to the beam structure which supports the rails upon which the covers are carried to and from their position over the openings in the several furnace chambers.

Furnaces of this type are normally arranged in batteries, each comprising a number of refractory-lined chambers within which ingots are heated to their rolling temperature of greater than 2000° F. The openings through which access to the respective chambers is obtained are normally disposed on the top of the unit and are closed by large, heavy refractory-lined covers in order to retain the heat within the chambers. The covers are usually mounted on self-propelled, remote-controlled wheeled carriages which run on beam-supported rails whereby they can be conveniently manipulated to open or close the chamber openings when access to the interior is desired. For the sake of compactness, the rails associated with the covers of two adjacent chambers may be supported on the same support beam which is disposed along the top of the median wall that divides the two chambers. Support beams of the type referred to above are as shown and described in U.S. Pat. No. 2,920,769 which issued Jan. 12, 1960 to H. F. Spencer. Because of their proximity to the furnace chambers such support beams are subjected to severe thermal stressing due to constant heat conduction through the walls and framing structure of the furnace and to the intermittent exposure to the radient effects of the interior of the adjacent chambers when the covers are removed. Such thermal stressing, coupled with the heavy physical loading on the support beams renders them prone to excessive deflection. Oftentimes, when this occurs, only two of the four carriage wheels are caused to contact the rails thereby concentrating the reactive forces on the cover which, in severe cases, will cause cracking of the refractory lining and premature failure of the cover.

To remedy this condition and to extend the life of the beam structure, it has been proposed to increase the size of the support beam and to employ means for fluid cooling the same with water or air as the coolant. However, the use of a beam of increased size, besides adding significantly to the fabricating and operating cost of the furnace oganization, also requires complete redesign and replacement of the cover carriage in order to accommodate a support beam of larger dimensions. Obviously, this need compounds the cost of the apparatus but, in addition, it imposes the additional requirement of having to incur the cost of maintaining the cooling system.

It is to the improvement of such apparatus, therefore, that the present invention is directed.

SUMMARY OF THE INVENTION

According to the present invention there is provided in an industrial furnace arrangement including upstanding end and median walls defining a plurality of mutually adjacent chambers; the tops of said walls cooperating to define substantially rectangular openings to said chambers; covers for said openings; wheeled carriages mounting said covers; a plurality of rails parallel to the tops of said median walls engaging the wheels of said carriages for guiding the movement of the same toward and away from said openings; the improvement comprising rail-support beam structure including an elongated, upstanding web, a base flange coextensive with said web and connected thereto along the bottom edge thereof, rail mounting means upon the upper surface of said base flange, and means for mounting said beam structure above the top of said median wall.

It is a principle object of the invention, therefore, to provide a rail-support beam structure of the described type which is spaced further away from immediate proximity of the furnace interior and therefore less subject to the heat issuing therefrom during periods of furnace operation.

It is a further object of the present invention to provide a rail-support beam structure of the described type having simple, yet effective, means for protecting the exposed regions of the structure against harmful thermal effects.

It is another object of the invention to provide a rail-support beam structure particularly adapted for use in mounting the cover carriages of soaking pits that is capable of maintaining four-point support of the carriage and thereby is able of preventing damage to the refractory lining of the cover for an extended period of time as compared with comparable structure of the prior art.

For a better understanding of the invention, its operating advantages and the specific objectives obtained by its use, reference should be made to the accompanying drawings and description which relate to a preferred embodiment thereof.

DESCRIPTION OF A PREFERRED EMBODIMENT

Figure 1:
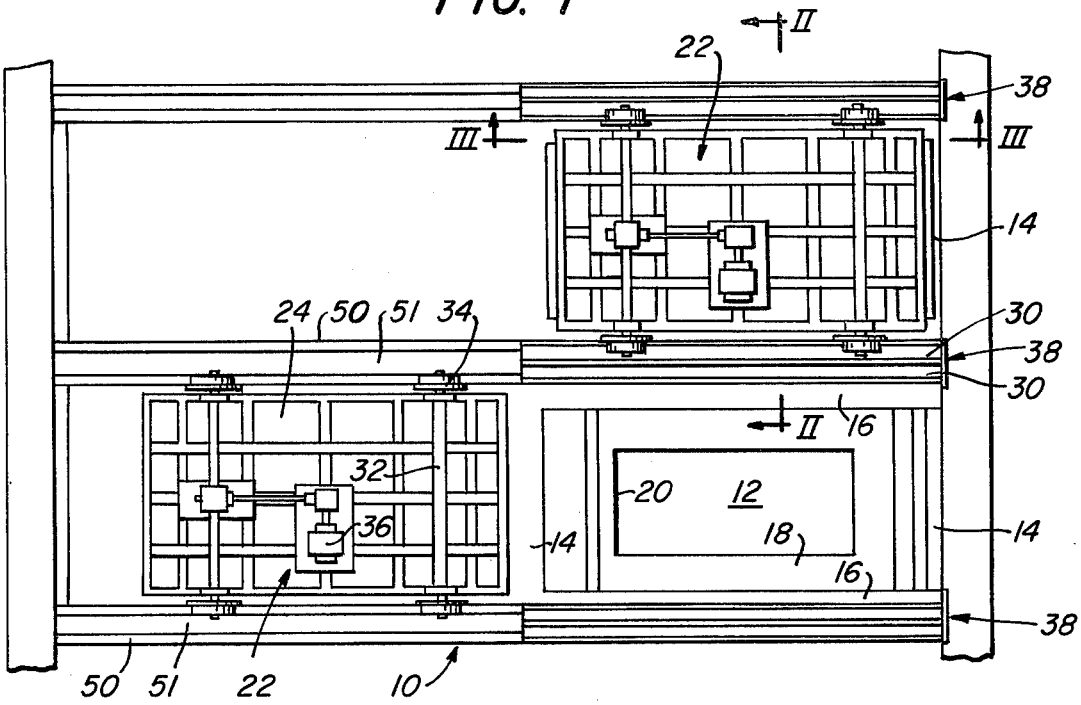
FIG. 1 is a plan view of an industrial furnace oganization of the soaking pit type utilizing the invention described herein.
Figure 2:
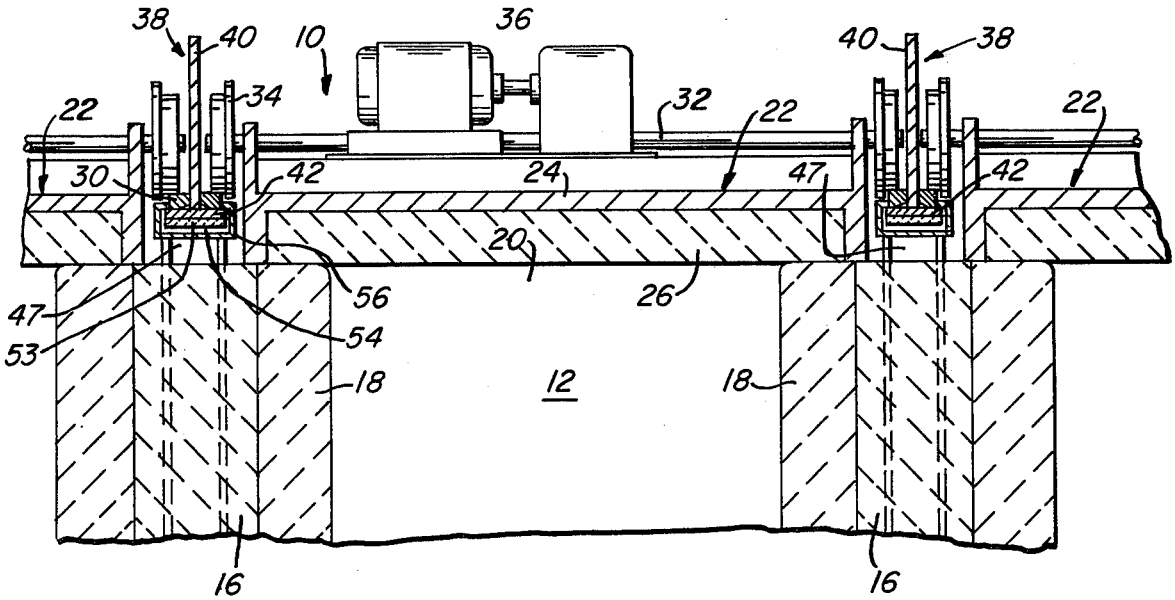
FIG. 2 is a partial vertical section taken along line 2—2 of FIG. 1.

Referring now to the drawing there is shown in FIGS. 1 and 2 an industrial furnace organization 10 of the soaking pit type incorporating the improvements of the present invention. The organization includes a battery of laterally spaced chambers or pits 12 defined by rectangularly disposed, upstanding end and median divider walls, 14 and 16 respectively. Each of the furnace walls 14 and 16 lined with a layer 18 of refractory material and contains a rectangular opening 20 at the top by which access to the chamber 12 is obtained. Each opening 20 is closed by a removable cover assembly, indicated as 22 in the drawing, which includes a cover body 24 containing refractory lining 26 and mounted for movement to and from its closed position on a wheeled carriage that runs on rails 30. The carriage consists essentially of a pair of longitudinally spaced axles 32 appropriately journaled in the cover body 24 and mounting flanged wheels 34 on each end that are adapted to engage the rails 30. The cover assembly 22 is driven by a remotely operated motor 36 mounted upon the cover body 24.

Figures 3, 4, 5, 6:
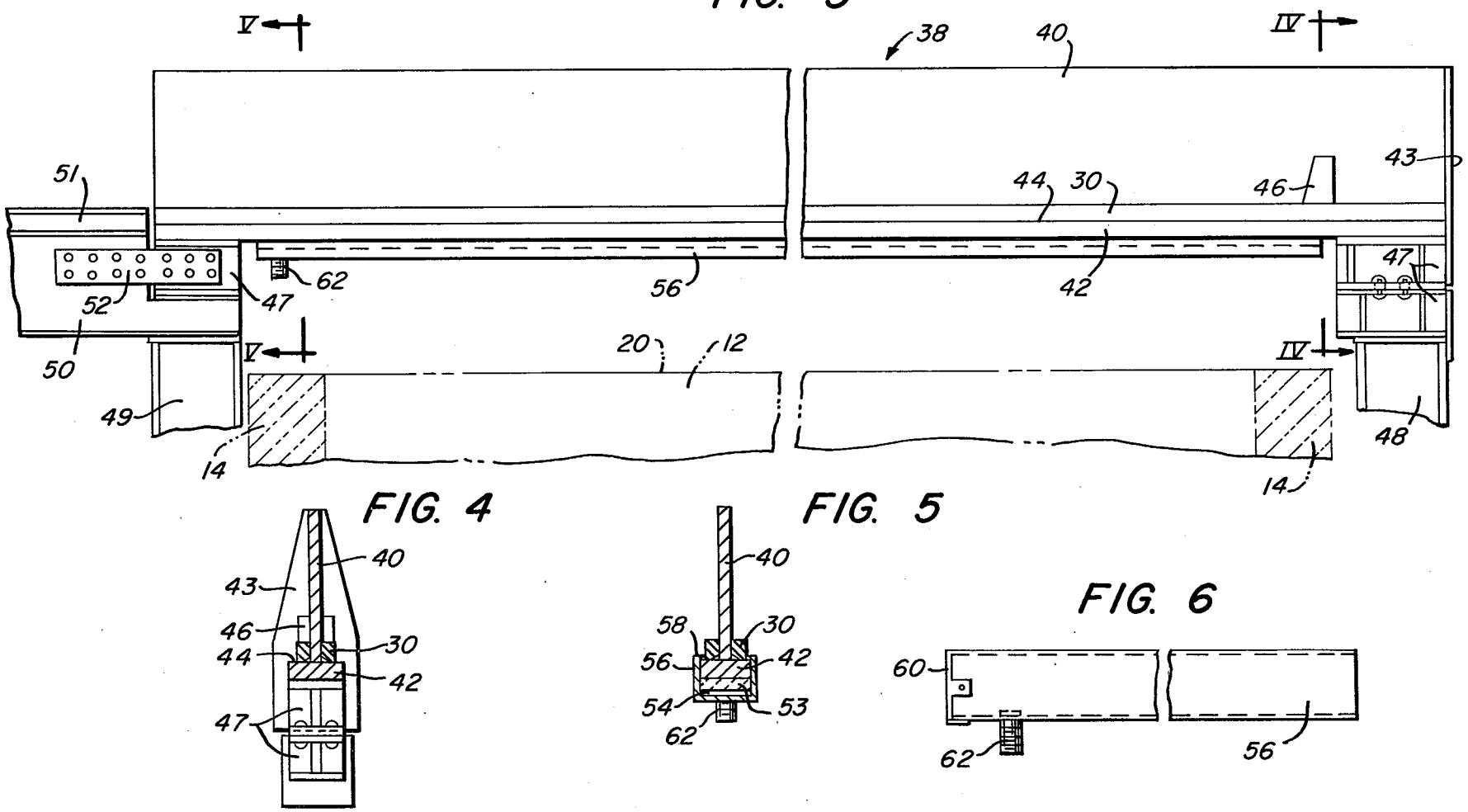
FIG. 3 is an elevational view of the beam structure of the present invention shown in greater detail.
FIG. 4 is a sectional view taken along line 4—4 of FIG. 3.
FIG. 5 is a sectional view taken along line 5—5 of FIG. 3.
FIG. 6 is an enlarged partial elevational view illustrating the thermal shield structure of the present invention.

According to the present invention the rails 30 upon which the respective cover assemblies 22 in the immediate proximity of the openings 20 are carried are vertically supported by beam structures 38 that extend parallel to the median walls 16 of the respective chambers 12. Each beam structure 38 comprises, as best shown in FIGS. 3 through 5, an elongated structural member including an upstanding web 40 that is weldedly connected along its bottom edge to a horizontal base flange 42. The web 40 is attached to the base flange 42 substantially along its midline to define a member having an inverted T configuration. A brace plate 43 provided at one end of the structure serves to stiffen the member.

The upper surface 44 of the base flange 42 on each side of the web 40 is adapted to mount one of the rails 30 associated with the adjacent cover assembly 22 such that each beam structure 38 carries a pair of rails 30. While the rails 30 may be of conventional form, they are more preferably formed of bars having a rectangular cross sectional configuration such that the side and bottom surfaces thereof present a substantial surface area contiguous with the facing surfaces of the web 38 and base flange 42 respectively in order that heat conduction between the flange and web will be enhanced for reasons hreinafter explained. The rails 30 may each be provided at the appropriate corner with a chamfer to accommodate the weldments connecting the web to the base flange in order to improve the possibility of contiguity between the rail sides and those of the web and base flange respectively. Wheel bumpers 46 may be provided on the rails 30 to limit the travel of the cover assembly 22.

Each beam structure 38 is supported at its opposite ends through structural mounts 47 upon columns 48 and 49 that may be part of the furnace framing structure. The beam structure 38 is longitudinally aligned with a support beam 50 extending beyond that region of the organization that is adversely affected by furnace temperature. Such beam 50 may be of conventional I-shape and carrying rails 51 aligned with the rails 30 to receive the carriage wheels 34 when the cover is in its removed position. To accommodate thermal expansion of the beam structure 38 it is fixedly attached at one end through splice plates 52 to the beam 50 while, at its other end, it is attached through slotted connections in the mounting structures 47 that permits longitudinal movement of the beam structure with respect to the associated column 48.

As shown best in FIG. 2, the beam structure 38 is arranged in vertically spaced disposition above the top of the median wall 16 thus permitting ample circulation of air about the component members in order to cool the structure. However, if desired, the base flange 42 may accommodate a layer of insulation material 53 at least along that portion of is length that is exposed to the radiant effects of the chamber interior when the cover assembly 22 is removed. The insulation material 53 is preferably in the form of boards that may be connected to the undersurface of the base flange 42 by means of studs (not shown).

Also, it is contemplated, in aggravated situations, to provide further cooling of the lower portion of the beam structure 38 by means of forced air circulation along the affected length. Such cooling is effected by means of an enclosed passage 54 formed by a thin plate 56 bent about the base flange 42 and having oppositely inturned flanges 58 along its upper portion for attachment to the upper surface of the base flange. The plate 56 is preferably formed of a metal having a reflective outer surface, such as stainless steel, in order to enhance its protective capability against the radient effects of the chamber. An end closure 60 closes the passage 54 at one end and means, such as a nipple 62 are provided adjacent that end for connection to a source of air under pressure, or other fluid coolant. The passage 54 may be open, as shown, when air is employed as a coolant or, when it is desired to retain a fluid coolant in a closed loop, the opposite end should also be closed by a plate (not shown) similar to end closure 60 and employ a nipple (not shown) similar to nipple 62 for connecting the passage to a closed loop circulating system.

It will be appreciated that the hereindescribed rail support structure is of such configuration as to be more effectively cooled and, thus, capable of providing a longer life under the influence of high temperature conditions. The beam is configured to provide a large heat sink which can receive the heat emitted from the furnace chamber and, due to the large amount of surface area provided by the upstanding web the heat can be dissipated by the convective effects of air flowing about the structure. For this reason it is contemplated to size the web, not only for the strength required to support the physical loading of the rails and closure cover assemblies upon the base flange but in large measure for the surface area provided therein to effect adequate dissipation of the heat imparted to the beam when the same is exposed to the high temperature conditions of the furnace. The beam structure will thus be subjected to less danger of undue thermal stressing and, therefore, will be capable of withstanding the heavy physical loadings imposed by the cover assemblies for longer periods without deflecting to an extent capable of causing damage to the refractory lining of the cover. This beneficial result will not only reduce the operating costs of the furnace organization by reducing the amount of necessary repair and replacement of the covers but will also reduce the amount of furnace down time attendant with maintenance of the covers.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. In an industrial furnace arrangement including upstanding end and median walls defining a plurality of mutually adjacent chambers; the tops of said walls cooperating to define substantially rectangular openings to said chambers; wheeled carriage-mounted covers for closing said openings; a plurality of rails parallel to the tops of said median walls engaging the wheels of said carriages for guiding the movement thereof toward and away from said openings; the improvement comprising support structure for said rails, said support structure including:

a. an elongated beam of inverted T-shaped cross sectional configuration having an upstanding web portion sized to present sufficient surface area to effectively dissipate heat therefrom to prevent inordinate thermal stressing of said beam;

b. a base flange coextensive with said web and connected thereto along the bottom edge thereof;

c. means for mounting said rails on the upper surfaces of said base flange on opposite sides of said web; and d. means for mounting said beam above the top of a median wall.

2. The improvement recited in claim 1 in which said rails are substantially rectangular in cross section and have their side and bottom surfaces contiguous with said web and base flange respectively.

3. The improvement recited in claim 1 including means for circulating a cooling medium in heat transfer relation to the undersurface of said base flange.

4. The improvement recited in claim 3 in which said heat transfer means comprises:

a. relatively thin plate means enclosing said base flange and defining a fluid passage therebeneath; and b. means for circulating a cooling medium through said passage.

5. The improvement recited in claim 4 in which said passage is closed at one end and including means adjacent said one end for admitting cooling medium to said passage.

6. The improvement recited in claim 4 in which said plate means is stainless steel.

7. The improvement recited in claim 5 in which said cooling medium is compressed air.

8. The improvement recited in claim 1 including a layer of insulating material attached to and extending along the undersurface of said base flange.

* * * * *